US006462659B1

(12) United States Patent
Schuette

(10) Patent No.: US 6,462,659 B1
(45) Date of Patent: Oct. 8, 2002

(54) PORTABLE REMOTE MAIL DETECTION SYSTEM

(76) Inventor: Kim M. Schuette, 7024 Creek Pl., Killeen, TX (US) 76549

( * ) Notice: Subject to any disclaimer, the term of this patent is extended or adjusted under 35 U.S.C. 154(b) by 0 days.

(21) Appl. No.: 09/897,094

(22) Filed: Jul. 3, 2001

Related U.S. Application Data

(60) Provisional application No. 60/216,023, filed on Jul. 3, 2000.

(51) Int. Cl.[7] ..... G08B 13/14

(52) U.S. Cl. ..... 340/569; 340/570

(58) Field of Search ..... 340/539, 545.3, 340/569, 570, 531; 200/61.63, 61; 232/35, 36, 37; 379/102.07, 281, 286

(56) References Cited

U.S. PATENT DOCUMENTS 4,013,838 A * 3/1977 Tsai ..... 379/201.07
4,314,102 A * 2/1982 Lowe et al. ..... 340/569
4,633,236 A * 12/1986 Buhl ..... 340/569
5,239,305 A * 8/1993 Murphy et al. ..... 340/569
5,440,294 A * 8/1995 Mercier et al. ..... 340/569
6,275,154 B1 * 8/2001 Bennett et al. ..... 340/569

* cited by examiner

*Primary Examiner*—Van Trieu
(74) *Attorney, Agent, or Firm*—David Lundy

(57) ABSTRACT

A device and system for checking the presence or absence of mail in a neighborhood delivery mailbox which has a plurality of individual mailboxes. The interrogation and response signals are triggered by remote control from a nearby location, for example from a moving vehicle. A custom identifying means is used to identify a selected mailbox from a cluster of mailboxes. This device and system thereby saves the operator time and provides a secure means of detecting mail from a remote location. The unit may be made miniature, as well as modular. The circuits described can be an integrated circuits or can be made of multiple discrete elements. The hand-held remote interrogator includes an antenna connected to a transmitter, and a receiver which is also connected to an antenna. A micro-controller is also provided to save, store and transmit data responsive to a query from a portable, hand held remote interrogator.

15 Claims, 3 Drawing Sheets

PORTABLE REMOTE MAIL DETECTION SYSTEM

FIELD OF THE INVENTION

This utility paten application claims priority of provisional patent application 60/216023 filed Jul. 3, 2000, which is incorporated by reference herein. This utility patent application further claims priority of Disclosure Document filed Aug. 26, 1999.

The present invention relates to devices and systems for checking the presence or absence of mail. More particularly, the invention relates to devices and systems for checking the presence or absence of mail by remotely electronically interrogating a selected mailbox in a cluster of mail box units, and signaling the presence of mail within the selected mailbox.

BACKGROUND OF THE INVENTION

Prior art mailbox deposit indicators, which are typically electrical or electronic in nature, have been made wherein such devices transmit to a fixed receiver located at a household upon activation of a mailbox door by a postman. However, in modern day pedestal mailbox systems, the mailboxes are accessed by the mailman by opening of a large, common rear door to multiple mailboxes, thereby bypassing the individual front mailbox doors altogether. Thus, the prior art mailbox deposit indicators are unsuitable for such rear-opening mailboxes. Additionally, there is no provision for a portable hand held interrogator, whereby a user can determine the presence of mail in their mailbox, from their automobile, or where walking or bicycling nearby.

Various devices are known which have been taught for detecting the presence of incoming mail in a mailbox. For example, opening of a mailbox door has actuated a signal, as taught in U.S. Pat. No. 3,611,333, U.S. Pat. No. 3,707,260, U.S. Pat. No. 3,909,819, and U.S. Pat. No. 4,314,102, as well as in Swiss Patent No. 600,844.

Additionally, fixed remote means for resetting an indicator from inside a household are taught in U.S. Pat. No. 5,239,305, U.S. Pat. No. 4,794,377, and U.S. Pat. No. 3,909,819.

In another type of device, U.S. Pat. No. 4,794,377 teaches use of a photo diode which indicates the presence of mail by optical reflection and then transmits a signal.

U.S. Pat. No. 5,861,805 to Reeves teaches a drop box signalling device. In this patent, automated querying is taught of collection receptacles via a passing vehicle.

U.S. Pat. No. 4,633,236 to Buhl teaches a mailbox having an indicator indicating the presence of mail. It uses a weight actuated indicator element.

U.S. Pat. No. 5,382,945 to Novak teaches a mail slot alarm. The alarm alerts recipients that mail has passed through a slot, and can include a beeper or other sounder, or a light.

U.S. Pat. No. 5,440,294 to Mercier et al. teaches a mail delivery signal system. In this system, a transmitter is mounted on a mailbox, and indicates when a mailbox door is opened.

SUMMARY OF THE INVENTION

According to the present invention, a device is provided which meets the aforementioned requirements and needs in the prior art. Specifically, the device according to the present invention provides a portable, remote device for checking the presence or absence of mail, in a neighborhood delivery cluster mailbox unit, which comprises a plurality of individual mailboxes, rural mailboxes or mail centers. The interrogation and response are triggered by remote control, from a portable hand held interrogator device, carried by the user, or while located in a moving vehicle.

The present invention relates to a modular indicator system for indicating the presence or absence of mail in a neighborhood delivery pedestal unit, rural postal box, or mail centers. The present invention includes two components, a mail sensor system mounted in a mailbox, and a portable hand-held remote interrogator, which is preferably similar in appearance to a garage door opener or a key chain remote control device for a car alarm.

In use, a typical user would approach their mailbox, perhaps while walking or driving in their automobile, and press an actuation button on the portable interrogator device to cause an interrogation signal to be sent to the mail sensor system, together with a custom identifying means. The portable interrogator thus queries the mail sensor, and receives a positive or negative response which actuates a visual or audible signal on the portable interrogator, which is indicative of the presence or absence of mail within the selected mail box.

Accordingly, an object of the present invention is the provision of a portable remote query device which allows an individual to detect mail in a neighborhood delivery pedestal mail center or rural postal box, upon demand, from a moving vehicle. This saves time, effort, and energy, and also prevents unnecessary exposure to the elements by an individual during checking of an empty mailbox during inclement weather.

This novel device and system thereby saves the operator time and provides a secure means of detecting mail without leaving a relatively safe vehicle. This avoids unnecessarily exposing the operator to bodily harm or threats from possibly nearby criminal or otherwise hostile persons.

The device and system of the present invention provides miniaturization in the portable remote query device, so that it is sufficiently small to be convenient to carry and operate.

Further, the device and system of the present invention is readily installed, requiring no handy-person skills.

Additionally, an object of the present invention is the provision of a portable remote query device which allows a pedestrian individual, for example in an apartment building, to detect mail in their local delivery pedestal, upon demand. This saves time, effort, and energy.

Also, an object of the present invention is the provision of a convenient system accessible to handicapped persons to check mail detection, saving time, effort, and energy in avoiding unnecessary trips to their mailbox.

Further, an object of the present invention is the provision of a portable remote query device which allows an individual to detect mail in a neighborhood delivery pedestal mailbox or rural postal box, upon demand, and which is producible at a relatively low cost as compared with other related types of devices, and having a relatively reduced number of moving parts.

Additionally, a number of remote control units can be provided for a single household, so that a plurality of persons can separately check for mail from a remote location.

It is a further object of the present invention, to provide multiple sensors for large mail boxes to insure that the signal is actuated when mail is delivered to a specific mailbox.

It is a still further object of the present invention, to provide a portable remote query device having a variety of identification means, to provide access to a selected mail box in a multi-mailbox environment.

Other objects and advantages of the present invention will be more readily apparent from the following detailed description when read in conjunction with the accompanying drawings.

DETAILED DESCRIPTION OF THE INVENTION

Figure 1A:
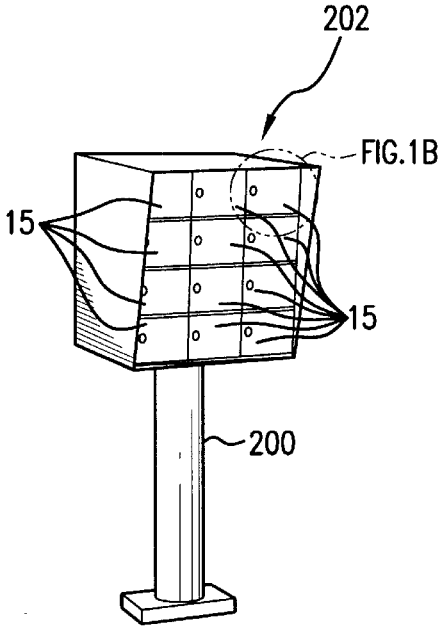
FIG. 1A is a perspective view of a neighborhood pedestal delivery mailbox, wherein at least one of the individual mailboxes has at least one sensor, according to the present invention.

A mail sensor system 100 for electronically checking the presence or absence of mail is shown in FIG. 1, in which a neighborhood delivery mailbox pedestal 200 has a plurality of individual mailboxes 14. An individual mailbox 14 is shown in exploded view in FIG. 1 with its mailbox door 15 open, in which the mail sensor system 100 is shown as having a signal sensing means 80 and a signal generating means 82. The interrogation and response signal are triggered by remote control from a portable hand held remote interrogator device 13. A user may use the portable handheld remote interrogator device 13 from a moving vehicle, while walking or riding a bicycle near by, or from a near by dwelling.

Figure 1B:
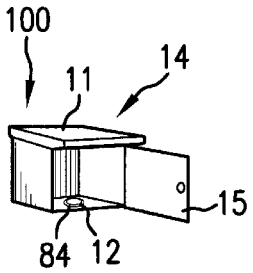
FIG. 1B is a perspective view of one of the mailboxes shown in FIG. 1A.

The system, which is preferably modular, is a mail sensor system 100 for indicating the presence of mail in a neighborhood delivery or rural postal mailbox 14. A mail sensor unit 11, and a reflector element 12, are located within the mailbox as shown in FIG. 1B. For larger mailboxes, two sets of sensors 20, 22 may be used, side by side, or in the front and rear portions of the mailbox.

Figure 3:
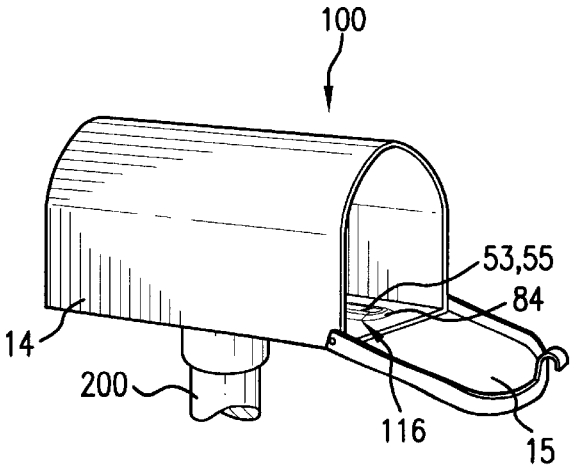
FIG. 3 is a perspective view of a rural mailbox having an LED sensor system located below the mailbox opening, according to the present invention.
Figure 7:
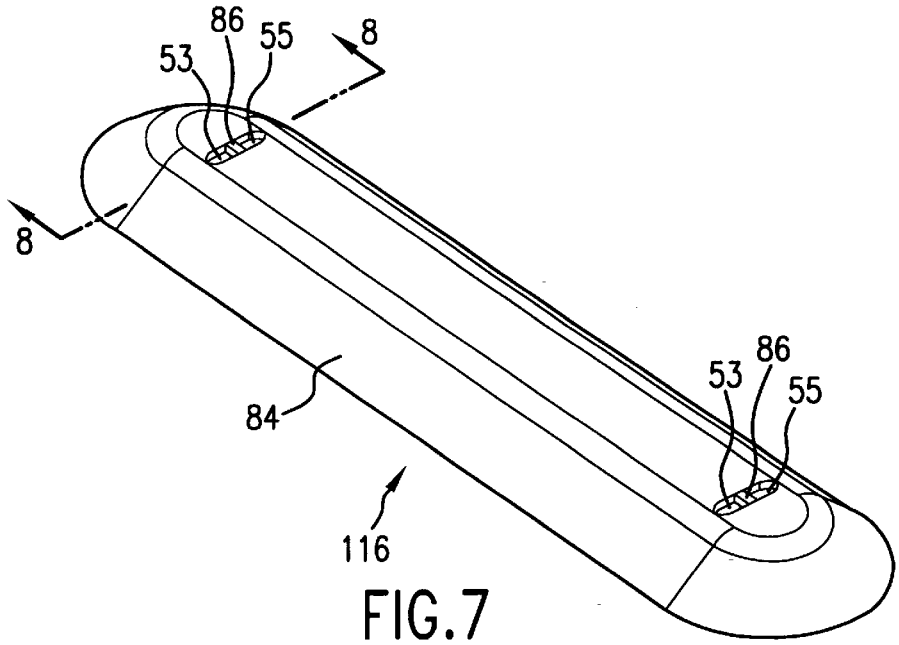
FIG. 7 is a perspective view of the sensor system prior to installation in a mailbox.
Figure 8:
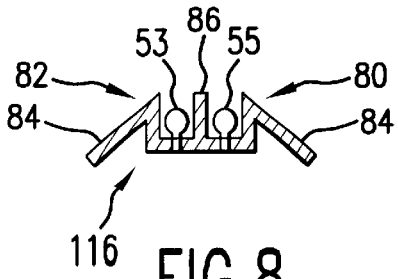
FIG. 8 is a cross sectional view of the photodiode and sensor, taken along lines 8—8 in FIG. 7.

Preferably, an optical sensing system 116, as shown in FIG. 7, is placed in the mailbox, and secured inside the mailbox, as shown in FIG. 3. The optical sensing system 116 includes at least one signal generating means 82 and a signal sensing means 80, positioned side by side, as shown in FIG. 8, with an opaque divider 86 placed between the signal generating means 82 and signal sensing means 80. When a letter is placed within the mailbox, the light from the signal generating means 82 is at least partially modified by the presence of the letter, perceptibly changing the light received by the signal sensing means 80. This change in light intensity is signaled to the microcontroller 52, which transmits the signal to a portable remote interrogator device 13, when queried by a unique identifying means 118.

Figure 2:
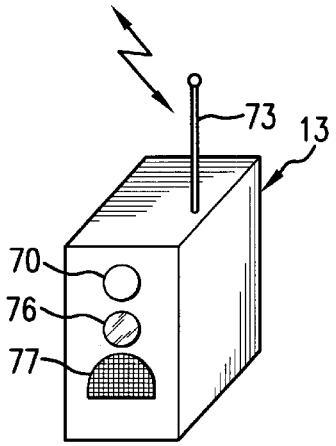
FIG. 2 is a perspective view of a remote portable interrogator unit according to the present invention, having a switch, indicator light, a sensing means and an antenna.

A portable hand-held remote interrogator 13 is schematically shown in FIG. 2, but in use may preferably be made to be similar in appearance to a garage door opener, or a key chain remote control device for a car alarm. As shown in FIG. 2, the portable hand-held remote interrogator 13 includes a push button switch 70, an antenna 73 and at least one of a LED indicator light 76 and an acoustical sounding device 77. The antenna 73 communicates with a transmitter/receiver element 112 in the mail sensor unit 11 (described further hereunder in FIGS. 5A and 5B).

In operation, a typical user would approach their individual mailbox 14, perhaps while driving in their automobile, or while bicycling or walking nearby, and press an actuation button 70 on the remote portable interrogator device 13, to cause it to send an interrogation signal to the mail sensor system 100. The interrogation signal includes a custom identifying means 118. The remote, portable hand held interrogator device 13 thus queries the mail sensor system 100, and upon verification of the custom identifying means 118, receives a positive or negative response.

For example, a LED indicator light 76 lights to indicate a positive signal, and/or the acoustical sounding device 77 emits a sound, such as a beep, to indicate a positive signal. While both the LED indicator light 76 and the acoustical sounding device 77 are present, either may be omitted, or some other indicating means provided, such as a tactile vibration device 34, to indicate to the user a positive or negative signal, and all such variations are within the scope of the present invention. The visual signal means, the audible signal means and/or the tactile vibration means may also be used intermittently, to indicate low power.

In one variation, the acoustical sounding device 77 emits a sound, such as a beep, to provide audio feedback indicating that the portable, hand-held remote interrogator 13 has been actuated, and a response signal has been received.

FIG. 3 is a perspective view of a rural mailbox 14 having a mail sensor system 100 installed therein. The optical sensing system 116 is secured to the bottom inside portion of the rural mailbox 14. The mounting of the optical sensing system 116 within the mailbox 14 may be performed by use of adhesive, glue, screw assemblies, or the like.

FIG. 7 shows the optical sensing system 116 prior to installation in a mailbox. FIG. 8 is a cross-sectional view of the optical sensing system 116, showing the signal generating means 82 and the signal sensing means 80 in side by side relation, with an opaque divider extending between the signal generating means 82 and the signal sensing means 80. Preferably, at least two optical sensing systems 116 are located in proximity to opposite ends of the optical sensing system 116. For larger mailboxes, multiple optical sensing systems 116 may be located in spaced, side-by-side relation, or end to end within a mailbox, to suit the size and shape of the mailbox.

Preferably, the outer periphery 84 of the optical sensing system 116 is tapered for ease of passing mail over the raised portion of the first and second signal sensing means 80, 82.

The optical sensing system 116 is sized to enclose the component parts of the mail sensor system 100, except for the portable remote interrogator device 13.

Figure 4:
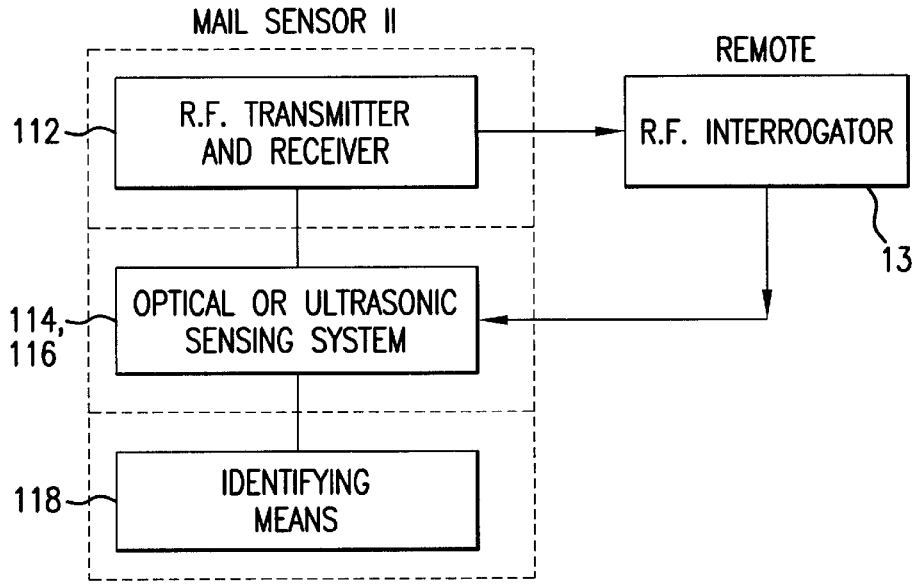
FIG. 4 is a schematic diagram of a modular version of the mail sensor and interrogator.

FIG. 4 is a schematic diagram of a modular version of the mail sensor 11 and the hand-held remote interrogator 13. As seen in FIG. 4, the mail sensor unit 11 includes an RF transmitter and receiver unit 112, and an optical sensing system 116 or an ultrasonic sensing system 114. The mail sensor unit 11 preferably communicates via radio with the portable hand-held remote interrogator 13, which also includes an RF transmitter and receiver 112 (shown in FIG. 6). The RF transmitter and receiver 112 shown in FIG. 4, preferably have a custom selected identifying means 118, which is distinct for a selected mailbox in a cluster of mailboxes.

Figure 5A:
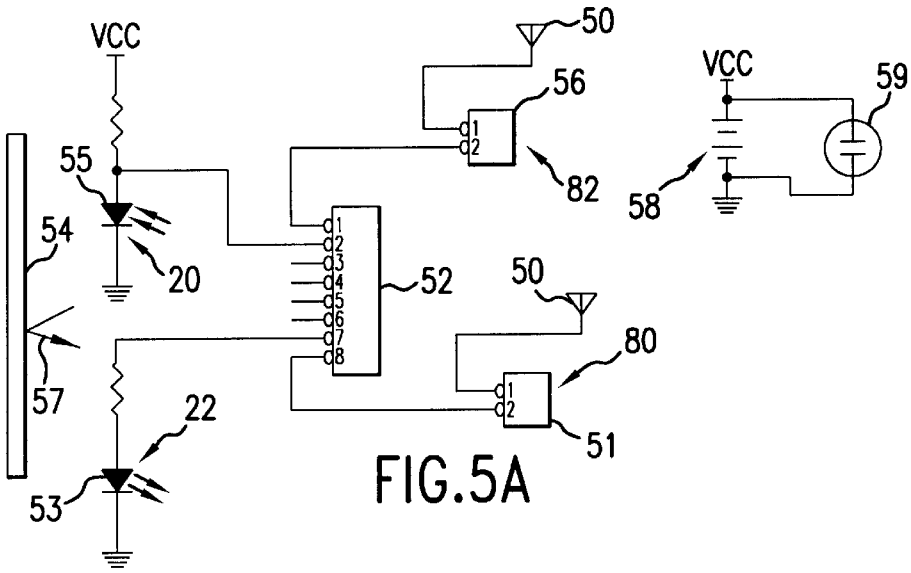
FIG. 5A is a schematic diagram of a circuit of a first embodiment of a sensor unit having a reflector element, a photodiode, a microcontroller, a transmitter and a receiver.

FIG. 5A is a schematic diagram of a circuit of a first embodiment of the mail sensor unit 11, having a reflector element 54. As seen in FIG 5A, the mail sensor system 100 includes a first RF antenna 63, an RF transmitter 56, a custom identification means 118, an RF receiver 51, a microcontroller 52, a light-emitting LED 53 emitting light to the reflector element 54, and a photodiode 55, for detecting the reflected LED light from the reflector element 54. The device of FIG. 5A is powered by a voltage VCC, which is supplied by a replacable or rechargable battery 58, by a photovoltaic (solar) element 59, or by power from a remote power supply, such as a 110 V power supply.

In operation, the triggering signal from the portable hand-held remote interrogator 13 contains a custom identifying means 118, which is recognized by the optical or ultrasonic sensing system 114. The transmitted signal from the portable remote interrogator device is received by the first antenna 63, which actuates emission of light from the LED 53. If mail is not present, the light is reflected by the reflector 54, and the reflected light 57 is detected by the photodiode 55. If mail is present, the light from the LED 53 is interrupted, so that the reflected light is changed, causing the photodiode 55 to sense the presence of mail within the selected mailbox 14. The custom identification means 118 is unique to an individual mailbox 14 within a cluster of mailboxes 202. The custom identification means 118 may be any known means for identifying a specific identification code, from a plurality of multiple identification codes. Preferably, there is one custom identifying means 118 for each mailbox in the mail box cluster 202.

Figure 5B:
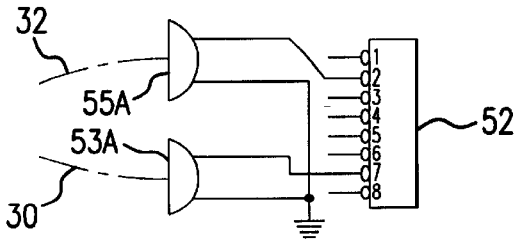
FIG. 5B is a schematic diagram of a circuit of a second embodiment of a sensor, having a microcontroller, an ultrasonic transmitter and an ultrasonic receiver.

FIG. 5B is a schematic diagram of a circuit of a second embodiment of the mail sensor unit 11, having acoustical detection means 30. In particular, in the embodiment of FIG. 5B, various elements are omitted since these omitted elements are essentially the same as those of FIG. 5A. More specifically, in FIG. 5B, the microcontroller 52 is connected to an ultrasonic transmitter 55A and to an ultrasonic receiver 53A. In this embodiment, the presence or absence of mail is detected by sound waves emitted within a selected mailbox 14.

In actual use, for example, the mail sensor unit 11 is calibrated when the mailbox is empty, so that any variation in received acoustic signals 32 is interpreted by the microcontroller 52 as the presence of mail. Alternatively, the microcontroller 52 may be preprogrammed to detect certain types of acoustic signals 32 as indicting the passage of sound through paper or plastic materials which form most packages or mail, so as to be interpreted by the microcontroller 52 as the presence of mail.

Figure 6:
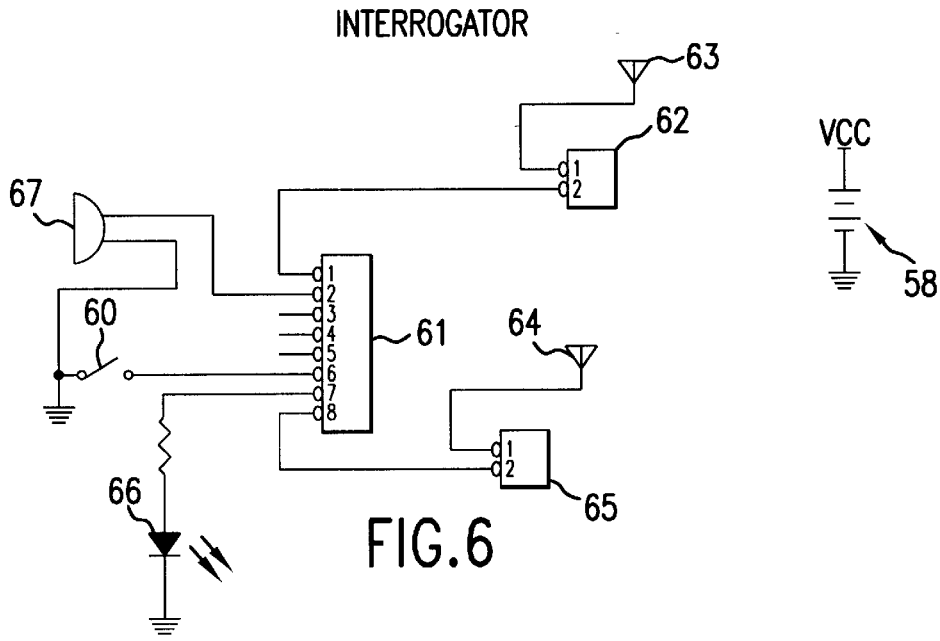
FIG. 6 is a schematic diagram of a circuit for a remote interrogator having a micro controller, a transmitter and a receiver.

FIG. 6 is a schematic diagram of a circuit for the remote interrogator 13. In this figure, the hand-held remote interrogator 13 includes a first antenna 63 connected to a transmitter 62, and a receiver 65 connected to a second antenna 64. A microcontroller 61 is connected to the transmitter 62 and the receiver 65, as well as to an acoustical device 67, a switch 60, and an LED 66. The microcontroller 61 may be located in the portable interrogator 13 or in the individual mailbox 14, to suit manufacturing preference.

The operation is similar to the operation discussed hereinabove, wherein the switch 60 is preferably a push button type switch, whose actuation initiates transmission of a signal from the transmitter 62 via the first antenna 63 to the mail sensor unit 11. A custom identifying means 118 is also sent as part of the transmission signal. A response from the mail sensor unit 11 via the second antenna 64 and the receiver 65, is then sent to the portable interrogator unit 13, responsive to the presence of mail in the individual mailbox 14. The response signal actuates an audible, visual or tactile vibrating signal on the portable, hand held interrogator device 13, to signal the user of the presence or absence of mail in their personal mailbox.

The mail sensor system 100 may be made miniature, as well as modular. The circuits described herein can be integrated circuits or can be made of a combination of discrete elements. All such variations are contemplated as being within the scope of the present invention.

The invention being thus described, it will be evident that the same way be varied in many ways. Such variations are not to be regarded as a departure from the spirit and scope of the invention and all such modifications are intended to be included within the scope of the claims.

PARTS LIST

100 - Mail sensor system
112 - RF transmitter and receiver unit
114 - optical or ultrasonic sensing system 45
116 - optical sensing system
118 - custom identifying means
200 - mailbox pedestal
202 - cluster of mailboxes
11 - mailing sensor unit
12 - reflector element
13 - portable remote interrogator device
14 - individual mailbox
15 - mailbox opening
20 - first sensor
22 - second sensor
30 - acoustical detection means
32 - acoustical signal
34 - tactile vibration device
51 - RF receiver
52 - microcontroller
53 - LED (light emitting diode)
53A - ultrasonic receiver
54 - reflector element
55 - photodiode
55A - ultrasonic transmitter
56 - RF transmitter
57 - reflected light
58 - battery
59 - photovoltaic element
60 - switch
61 - microcontroller
62 - transmitter
63 - first antenna
64 - second antenna
65 - receiver
66 - LED
67 - acoustical device
70 - push button switch
73 - antenna -continued

| PARTS LIST |
| --- |
| 76 - indicator light |
| 77 - acoustical sounding device |
| 80 - signal sensing means |
| 82 - signal generating means |
| 84 - outer periphery |
| 86 - opaque divider |

I claim:

1. A portable remote mail detection apparatus, which comprises:

a) a custom identifying means for identifying a selected mailbox from a plurality of mailboxes located at a common site, each selected mailbox with a front portion, an aperture in the front portion for receiving mail, a back portion, a bottom portion, opposing side portions and a top portion;

b) a at least one sensing means, for sensing the presence of mail within said selected mailbox, each said sensing means comprising at least one light emitting diode and at least one photo diode located in side by side relation, with an opaque barrier extending upwardly therebetween, said at least one sensing means positioned upon the lower portion of the mailbox housing, said at least one sensing means selectively actuated by a remote portable interrogator, and a change in the light signal between the light emitting diode and the side by side photo diode indicates the presence of mail within the selected mailbox;

c) a remote portable hand-held interrogator device for transmitting a selectively actuated query signal and said identification means to said sensing means located in the selected mailbox, and for receiving a transmitted response signal from said sensing means located in the selected mailbox upon confirmation of said identification means, responsive to the presence of mail within the selected mailbox; and d) a signal means on the remote portable hand held interrogator device for signaling the presence and absence of mail in said selected mailbox.

2. The portable means remote mail detection apparatus of claim 1, wherein the custom identifying means is an electronic signal, which is unique to a selected mailbox within a cluster of mailboxes.

3. The portable remote mail detection apparatus of claim 1, wherein the signal means on the remote portable hand held interrogator device for signaling the presence and absence of mail in said selected mailbox, comprises at least one of: an audible signal, a visual signal and a tactile vibrating signal.

4. The portable remote mail detection apparatus of claim 1, wherein the signal means is intermittently actuated to signal low power.

5. The portable remote mail detection apparatus of claim 1, wherein power is supplied to the sensors within the selected mailbox by a power supply means, comprising at least one of: replaceable batteries, rechargeable batteries, solar power and electric power from a remote power supply source.

6. The portable remote mail detection apparatus of claim 1, wherein the transmitter and receiver are each RF transceivers, and an antenna is provided to aid in the sending and receiving the selectively actuated signals between the remote interrogator and the selected mailbox.

7. The portable remote mail detection apparatus of claim 1, wherein a micro-controller stores, transmits and receives information between the remote interrogator and the selected mailbox.

8. The portable remote mail detection apparatus of claim 1, wherein each sensing means comprises at least one first ultrasonic sensor in ultrasonic communication with at least one second ultrasonic sensor located in side by side relation to the first sensor, and an ultrasonic barrier is positioned between the first and second ultrasonic sensors, and mail delivered into a selected mailbox alters the ultrasonic communication between said first and second ultrasonic sensors, and said sensing means indicates the presence of mail within the selected mail box when the interrogator selectively sends a query signal to the sensing means located within the selected mailbox.

9. A portable remote mail detection apparatus, which comprises:

a) an identification means for identifying a selected mailbox from a plurality of mailboxes with an electronic signal which is unique to a selected mailbox within a cluster of mailboxes;

b) at least one set of sensing means, each set of sensing means with at least one light emitting diode, for generating a signal within a selected mailbox, and at least one optical sensor located in side by side relation to the light emitting diode, for sensing the presence of a signal extending between the light emitting diode and the optical sensor, with an opaque barrier extending upwardly between the light emitting diode and the optical sensor located within the selected mailbox, and an identifiable change in the signal between the light emitting diode and the optical sensor indicates the presence of mail within the selected mailbox;

c) a remote portable interrogator device for selectively transmitting a query signal and said identification means to said sensing means located within the selected mailbox, and for receiving a transmitted response signal from said selected mailbox upon confirmation of said identification means, responsive to the presence of mail within the selected mailbox;

d) at least one signal means located upon the remote portable interrogator, said signal means selected from at least one of an audible signal means, a visual signal means and a tactile vibrating signal means, said signal means located on the remote portable interrogator device for signaling the presence and absence of mail in said selected mailbox in response to said selectively actuated query signal; and e) a microcontroller which stores, transmits and receives information between the remote interrogator and the signal means located within the selected mailbox.

10. The portable remote mail detection apparatus of claim 9, wherein the signal means is intermittently actuated to signal low power.

11. The portable remote mail detection apparatus of claim 9, wherein a first sensor is in ultrasonic communication with a second sensor, and mail delivered into a selected mailbox alters the ultrasonic communication between said first and second sensors, and a break in the ultrasonic communication indicates the presence of mail within the selected mailbox.

12. The portable remote mail detection apparatus of claim 9, wherein power is supplied to the sensors within the selected mailbox by at least one of: replaceable batteries, rechargeable batteries, solar power and electrical power from a remote electrical power supply source, and power is supplied to the remote portable interrogator by at least one of replaceable batteries, rechargeable batteries and solar power.

13. The portable remote mail detection apparatus of claim 9, wherein at least one light emitting diode and at least one optical sensor are located within an optical sensing system insertable within the selected mailbox, and the outer periphery of the optical sensing system is tapered to allow mail to more easily slide over the optical sensing system located upon the lower portion of the selected mailbox.

14. The portable remote mail detection apparatus of claim 9, wherein the transmitter located in the portable interrogator and the receiver located in the optical sensing system are each RF transceivers, and an antenna is provided to aid in the sending and receiving of selectively actuated signals between the remote interrogator and the selected mailbox.

15. A portable remote mail detection apparatus, which comprises:

a) a custom identification means for identifying a selected mailbox from a plurality of mailboxes with an electronic signal which is unique to a selected mailbox within a cluster of mailboxes;

b) at least one signal generating light emitting diode, for generating a signal within a selected mailbox, c) at least one optical sensing means for sensing the presence of a signal from said signal generating light emitting diode within said mailbox, and a change in the signal between the signal generating light emitting diode and the optical signal sensing means indicates the presence of mail within said selected mailbox;

d) a remote portable interrogator device for selectively transmitting a RF query signal and said custom identification means to said selected mailbox, and for receiving a transmitted RF response signal from said optical sensing means located within the selected mailbox upon confirmation of said custom identification means, responsive to the presence of mail within the selected mailbox;

e) an antenna for transmitting said RF query signal and for receiving a transmitted RF response signal from said selected mailbox;

f) at least one indicating means, said indicating means selected from at least one of an audible indicating means, a visual indicating means, and a tactile vibration sensing means, said indicating means located on the remote interrogator device, for signaling the presence of mail in said selected mailbox in response to said query signal; and g) a microcontroller which stores, transmits and receives information between the remote portable interrogator and the selected mailbox.

* * * * *